United States Patent [19]

Bert et al.

[11] Patent Number: 4,992,763

[45] Date of Patent: Feb. 12, 1991

[54] MICROWAVE RESONATOR FOR OPERATION IN THE WHISPERING-GALLERY MODE

[75] Inventors: Alain Bert, Gif Sur Yvette; Narguise Mamodaly, Paris; Pierre Guillon, Limoges; Luis Bermudez, Limoges, all of France

[73] Assignee: Thomson-CSF, Paris, France

[21] Appl. No.: 200,853

[22] Filed: Jun. 1, 1988

[30] Foreign Application Priority Data

Jun. 5, 1987 [FR] France ..... 87 07940

[51] Int. Cl.[5] ..... H01P 7/08; H01P 7/10

[52] U.S. Cl. ..... 333/219; 333/219.1

[58] Field of Search ..... 333/202, 219, 219.1, 333/235

[56] References Cited

U.S. PATENT DOCUMENTS

| | | | |
|---|---|---|---|
| 3,558,213 | 1/1971 | Marcatili | 350/96.12 |
| 4,097,826 | 6/1978 | Knox et al. | 333/202 |
| 4,727,342 | 2/1988 | Ishikawa et al. | 333/219.1 |
| 4,800,350 | 1/1989 | Bridges et al. | 333/239 |

FOREIGN PATENT DOCUMENTS

| | | | |
|---|---|---|---|
| 2152857 | 1/1973 | Fed. Rep. of Germany | 333/219 |
| 2415284 | 10/1974 | Fed. Rep. of Germany | 333/202 |
| 223902 | 12/1983 | Japan | 333/219 |

OTHER PUBLICATIONS

Shindo et al., "Low-Loss Rectangular Dielectric Image Line for MM-Wave IC's"; *IEEE Trans on Microwave Theory and Techniques*; vol. MTI-26, No. 10, Oct. 1978, pp. 747-751.

Jiao, X.A. et al.; "Whispering-Gallery Modes of Dielectric Structures: Applications to MM-Wave Bandstop Filters", *IEEE Trans on Microwave Theory & Techniques*, MTT35, No. 12, Dec. 1987, pp. 1169-1175.

IEEE Proceedings Section A A I, vol. 129, no. 4, Part H, Aug. 1982, pp. 183-187, Old Woking, Surrey, GB;C. Vedrenne et al., "Whispering-Gallery Modes of Dielectric Resonators" in its entirety.

*Primary Examiner*—Benny T. Lee

*Attorney, Agent, or Firm*—Oblon, Spivak, McClelland, Maier & Neustadt

[57] ABSTRACT

A microwave resonator for operation in the whispering-gallery mode is constituted by a resonant element included in a flat disk having a diameter (*2a*) which is considerably larger than its thickness (*2d*). An electromagnetic wave which propagates within the disk is confined between the periphery of this latter and a so-called caustic surface having a smaller radius ($a_c$). The wave does not radiate to the exterior and the resonator can be placed on a dielectric or metallic substrate. The disk can be hollowed-out within the caustic surface. A resonator can be simulated within the thickness of a dielectric substrate by at least one metallic ring which forms a magnetic short-circuit with the ground plane. Excitation is produced by microstrips or by dielectric image waveguides.

18 Claims, 5 Drawing Sheets

FIG_7
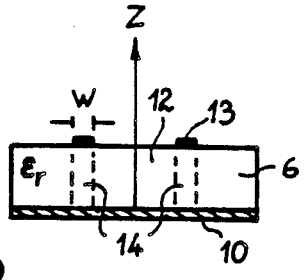
FIG_8
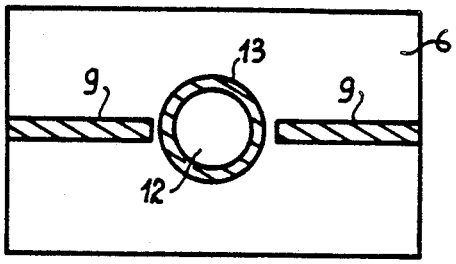
FIG_9
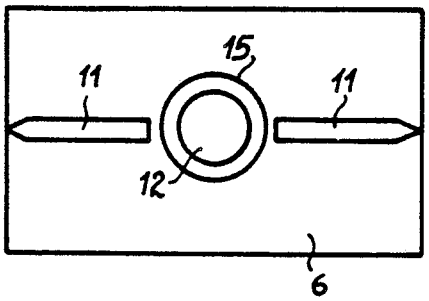
FIG_10A
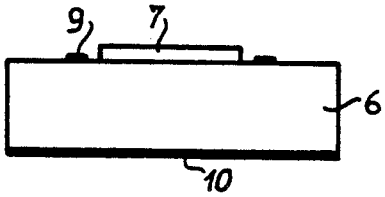
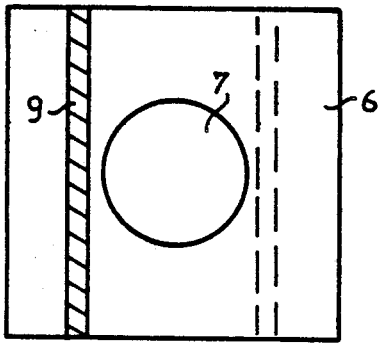
FIG. 10B
FIG_11A
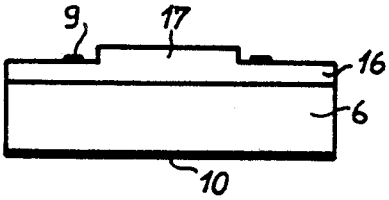
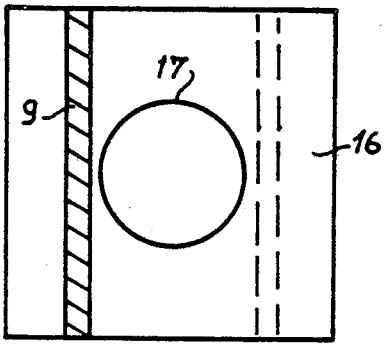
FIG. 11B FIG_12A
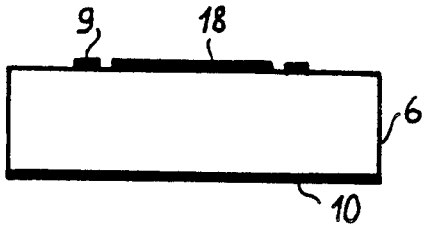
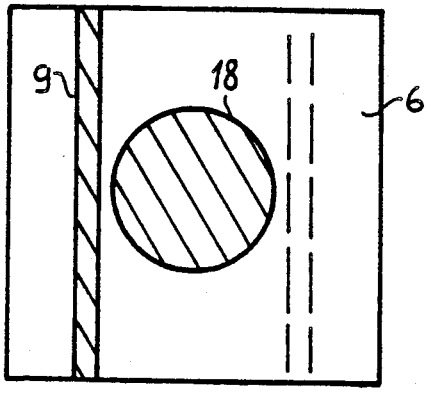
FIG. 12B
FIG_13A
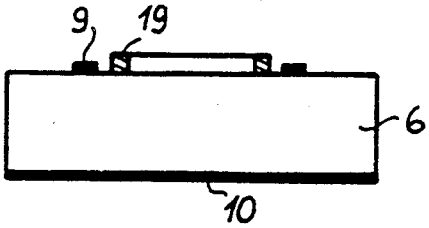
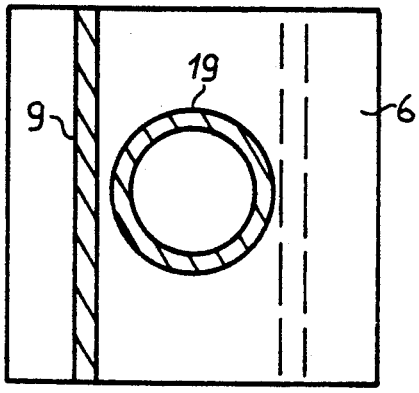
FIG. 13B
FIG_14A
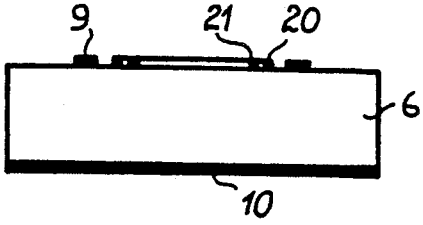
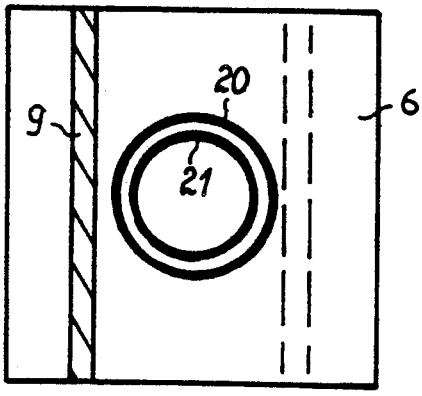
FIG. 14B
FIG_15A
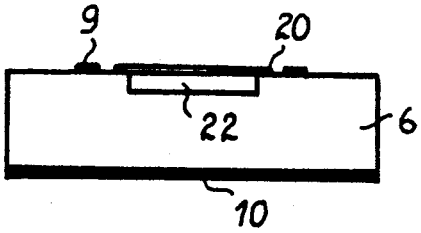
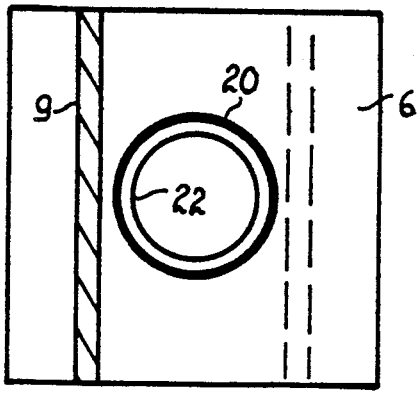
FIG. 15B FIG_16A
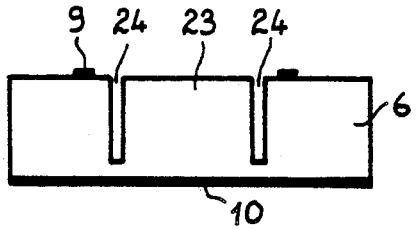
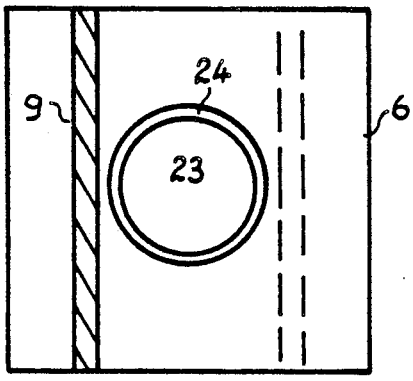
FIG. 16B
FIG_17A
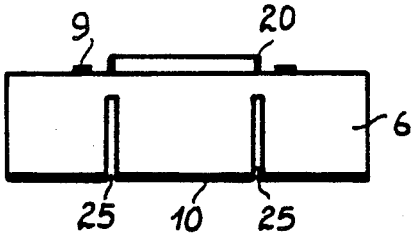
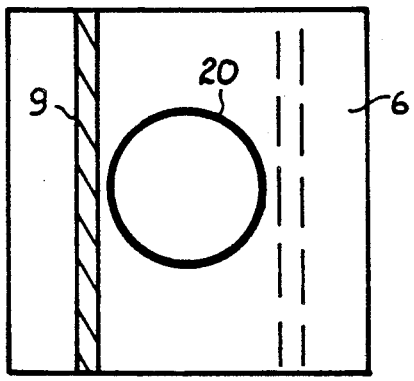
FIG. 17B
FIG_18A
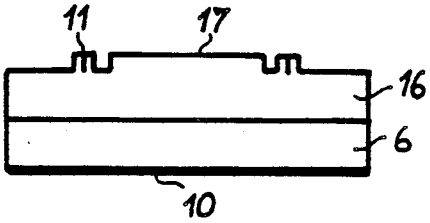
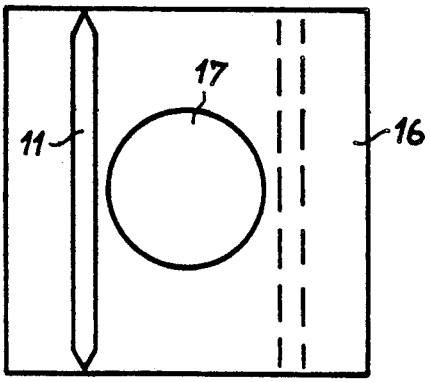
FIG. 18B
FIG_19A
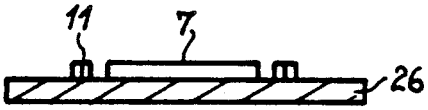
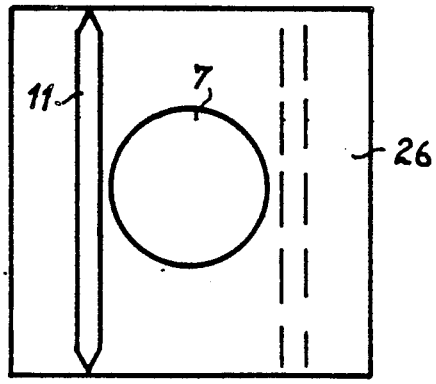
FIG. 19B FIG_20A
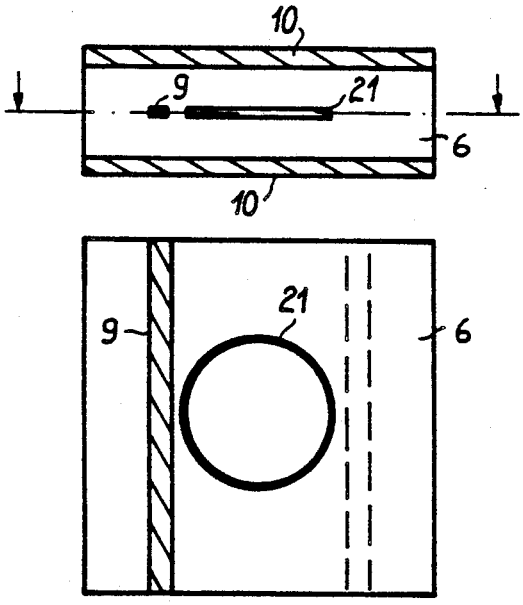
FIG. 20B
FIG_21
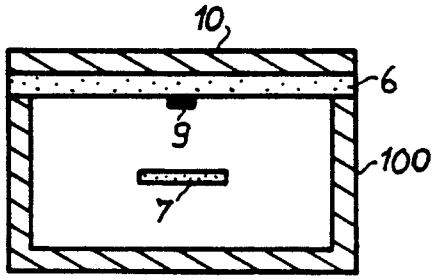

MICROWAVE RESONATOR FOR OPERATION IN THE WHISPERING-GALLERY MODE

BACKGROUND OF THE INVENTION

1. Field of the Invention

The present invention relates to a microwave dielectric resonator for operation in the whispering-gallery mode. This resonator is of the planar type or in other words is designed in the form of a flat disk which is either physically distinct from the components with which it cooperates or integrated in a small dielectric plate in which the flat disk is defined by a magnetic wall.

2. Description of the Prior Art

The whispering-gallery (WG) mode was discovered by Lord Rayleigh in the field of acoustics. Thus in a building which has a vaulted gallery architecture a sound as faint as a whisper is transmitted along the vault and is readily propagated over a long distance without loss of energy.

This type of propagation also finds applications in other fields including microwave techniques and the theory has been studied by Vedrenne and Arnaud in an article entitled "Whispering-gallery modes of dielectric resonators" published in IEE Proc. vol. 129, No. 4, pages 183–187, Aug. 1982.

In a cylinder of dielectric material in which an electromagnetic wave is propagated, the solution of the propagation equation makes it possible to define the longitudinal and transverse components of the modes which are capable of propagating. These modes are defined by an azimuthal number (propagation along the axis of the cylinder) and a radial number (propagation along a radius of the cylinder). In the case of modes having a high azimuthal number, the electric field E and magnetic field H which sustain the wave are confined between a so-called caustic surface and the lateral surface of the dielectric cylinder, which accordingly produces radial confinement.

Using the following notations:

a: radius of cylinder, $a_c$: radius of caustic surface,

R: radius of a point at which the waveform is considered, then in the case of $R<a_c$: the wave is evanescent, in the case of $a_c<R<a$: the wave is oscillating, in the case of $R>a$: the wave is evanescent.

Furthermore, it is known to trap these whispering-mode waves by reducing the diameter of the dielectric cylinder on each side of the disk region in which there exists a wave confined by whispering mode. The external radiation is in fact very weak since a whispering-mode wave is confined within a disk having a thickness *2d* in the case of a mode having a high azimuthal number.

The invention therefore proposes to construct the resonators for microwave devices, no longer by means of a cylinder of dielectric material having a length of the same order of magnitude as the diameter as in the prior art but by means of a disk of dielectric or metallic material which has a small thickness in comparison with its diameter and operates in the whispering mode, the frequency of the whispering wave being related to the radius of the disk, to the radius of the caustic surface and to the material employed.

By virtue of the fact that the electromagnetic wave is confined and that the external radiation is very weak, a resonator in accordance with the invention operates on any substrate whether of dielectric or metallic material.

Since this whispering-mode resonator is a flat disk, it may be deposited by screen process or the like or alternatively etched in a ceramic plate.

SUMMARY OF THE INVENTION

More specifically, the invention consists of a microwave resonator for operation in the whispering-gallery mode as distinguished by the fact that the resonant element is a flat disk having a diameter which is considerably larger than its thickness and a periphery which is the source of propagation of electromagnetic waves, the resonant frequencies of which are related to the diameter of the disk, said electromagnetic waves being confined by the whispering-gallery mode between the periphery of said disk and an internal surface known as a caustic surface.

BRIEF DESCRIPTION OF THE DRAWINGS

FIG. 7 is a sectional view of a pseudo-planar resonator which operates in the WG mode in accordance with the invention.

FIGS. 8 and 9 illustrate means for excitation and coupling with an external wave of a pseudo-planar resonator in the WG mode in accordance with the invention.

FIGS. 10 to 21 illustrate examples of construction of planar or pseudo-planar resonators in accordance with the invention.

DESCRIPTION OF THE PREFERRED EMBODIMENTS

Figure 1:
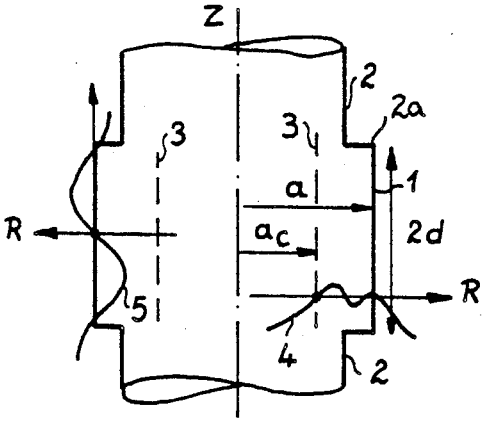
FIG 1 PRIOR ART
FIG. 1 is a diagram of a cylinder of dielectric material in which an electromagnetic wave is confined in the whispering-gallery (WG) mode in accordance with the prior art.

FIG. 1 illustrates a dielectric cylinder in which an electromagnetic wave is produced by suitable external coupling means. This cylinder 1 has an axis z and a diameter *2a*. In order to trap the confined wave in the whispering-gallery (WG) mode, a region of said cylinder having a length *2d* is defined by reducing at 2 the diameter of the cylinder externally of said region.

Resonance in the whispering-gallery (WG) mode may be described as a wave reflected against the concave wall of a cylinder at the curved interface between the dielectric medium and the surrounding air. The wave travels in the plane of a circle having a radius a perpendicular to the axis z and is confined by the dielectric-air discontinuity but also by a so-called caustic cylindrical surface 3 having a radius $a_c$ and coaxial with the dielectric cylinder having a radius $a>a_c$.

Figure 2:
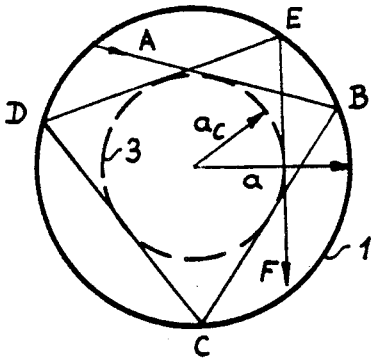
FIG 2 PRIOR ART
FIG. 2 is a representation, in the form of optical rays, of the confinement of a wave in the WG mode in accordance with the prior art.

FIG. 2 is a representation of the WG mode phenomenon in the form of an optical ray as shown in a plane perpendicular to the axis z. A light ray issuing from A is reflected from the concave surface of the cylinder 1 at B, C, D ... and thus defines a caustic surface 3 against which it always remains tangent. The process is exactly the same with an electromagnetic microwave.

A wave which travels in a medium is governed by a propagation equation which includes the longitudinal components (along the axis z) and transverse components (along a radius a) of the modes which are capable of propagating. With these components are associated an azimuthal mode number n, a radial mode number $\alpha$ and a constant h of propagation along the axis. In order to obtain a wave confined by whispering mode, it is necessary to ensure that h=0 and that the azimuthal mode number n is of high value and, in this case, the fields of excitation of the electromagnetic wave are confined between a caustic surface having a radius $a_c$ and the lateral surface of the cylinder having a radius a. If consideration is given to a point located at a distance R from the axis z, the wave is oscillating if $a_c < R < a$ the wave is evanescent if $R < a_c$ or if $R > a$.

Moreover, the axial confinement is improved if, as in FIG. 1, the dielectric cylinder 1 is reduced in diameter in the regions 2 external to the region in which the whispering-mode wave is generated. Thus the field of the resonant mode decreases exponentially in the axial direction z outside the large-diameter region.

This is represented in FIG. 1 by the two curves 4 and 5 which have been superimposed on the geometrical section. The curve 4 which gives the variation of the transverse field shows that the wave oscillates between $a_c$ and a and is evanescent within the caustic surface having a radius $a_c$ and externally of the cylinder having a radius a. Curve 5 which gives the variation of the axial field shows that the wave oscillates in the region of length 2*d* of the cylinder 1 and is evanescent outside this region. This accordingly constitutes in actual fact a resonator in the form of a disk in which an electromagnetic wave is confined by WG mode.

Furthermore, n designates the number of periods along the circle in radial cross-section or in other words the number of reflections at B, C, D, E, ... in the optical representation of FIG. 2. The frequency of the whispering wave depends on $a_c$, on a, on the nature of the material, therefore on its dielectric constant $\epsilon_r$, and to a slight extent on the length 2*d* of the cylinder region 1.

Since the fields of the WG modes are confined between the caustic surface and the external ray of the cylinder in which a wave exists, they have very low radiant power. For this reason, the quality factors Q associated with these devices have high values which are close to the intrinsic quality factors of the material and are limited solely by the losses within the material.

Moreover, these types of WG modes permit easy suppression of axially evanescent parasitic modes which are readily absorbed without disturbance of the other modes.

Finally, WG modes can exist within a metallic waveguide.

The object of the invention is to apply the WG mode as already known in the case of cylinders of dielectric materials to the construction of resonators, especially in the field of microwave electronics. In point of fact, whereas conventional cylindrical resonators have such small dimensions that they become difficult to handle at very high frequencies such as 10 to 100 GHz, for example, whispering-mode resonators are designed in the form of a flat disk having a very small thickness which may be deposited on a substrate by screen process or defined in a plate having larger dimensions.

Figure 3:
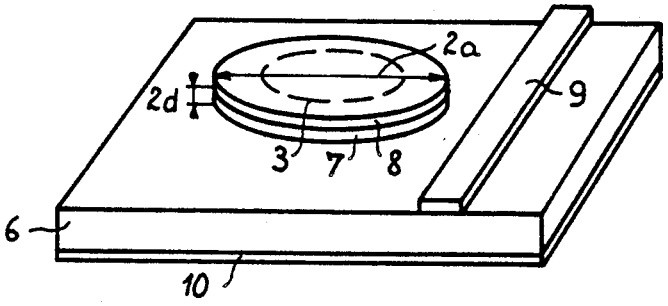
FIG. 3 is a third-angle projection of a planar resonator which operates in the WG mode in accordance with the invention.

The third-angle projection of FIG. 3 illustrates a first type of whispering-mode planar resonator in accordance with the invention.

This resonator consists of a small disk 7 of isotropic, anisotropic or piezoelectric dielectric material placed on a substrate 6 which can be either an isotropic material, an anisotropic material or a piezoelectric material or the substrate can be a metallic or resistive material. The disk 7 has a diameter 2*a* as defined earlier, a very small thickness 2*d* and the material has a permittivity $\epsilon_r$. The disk 7 can be covered by a metallic disk 8 whose usefulness will be explained in detail hereinafter. Said disk is excited and coupled with the exterior by means of at least one waveguide or a microstrip line 9 and its ground plane 10.

It may be stated by way of non-limitative example that, in the case of a WG-mode resonator:

the diameter 2*a* is of the order of 8 to 19 mm at frequencies of the order of 10 to 20 GHz, the thickness 2*d* is of the order of 0.2 to 1.3 mm, the permittivity is within the range of 9 to 36.

The resonance frequencies of the whispering modes excited within these resonators are practically independent of the thickness of the disk 7, the sole values affecting the thickness being the diameter 2*a* and the permittivity $\epsilon_r$ as shown in Table I in which it is also observed that the quality factors Q follow a trend which is comparable with the frequency and independently of the thickness.

This independence of the resonance frequency with respect to the thickness 2*d* of the disk can be confirmed by sandwiching the resonator 7 between two disks of absorbant materials. Thus the resonance frequencies and the quality factors are the same.

On the other hand, it is observed that the quality factor Q increases with the order n of the mode or in other words with the frequency. In fact, since the radiation decreases when the frequency rises, the quality factor tends towards the intrinsic value of the quality factor of the material. This is shown in Table II by comparison with the right-hand portion of Table I.

Whispering-gallery modes are classified as follows:

WGE modes having a radial electric field E,

WGH modes having an axial electric field E, depending on the manner in which they are excited. It is observed that, in the case of one and the same resonator, the quality factors Q are higher in the WGE modes than in the WGH modes as shown in Table III.

Finally, a comparison between Table II and Table IV shows that the resonance frequency decreases when the permittivity $\epsilon_r$ increases.

Excitation and coupling of the WG modes are obtained by synchronizing an external wave with the whispering-mode wave within the resonator disk.

Figure 4:
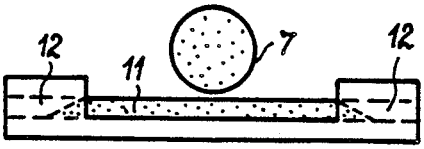
FIGS. 4, 5, 6 illustrate different means for excitation and coupling with an external wave of a planar resonator in the WG mode in accordance with the invention.

This coupling operation can be performed:

either by means of microelectronic lines: microstrip line as shown in FIG. 3 or slotted line, or by means of a metallic waveguide provided with a slot, or by means of a dielectric image waveguide, the permittivity of which is identical with that of the planar resonator in the WG mode. FIG. 4 illustrates the arrangement adopted for measuring n, F and Q which are given in Tables I to IV. The resonator disk 7 is maintained in proximity to a rod 11 which operates as a dielectric waveguide provided with transitions 12 towards a metallic waveguide (not shown in the drawings).

Figure 5:
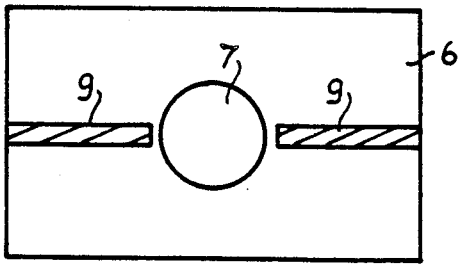
Figure 6:
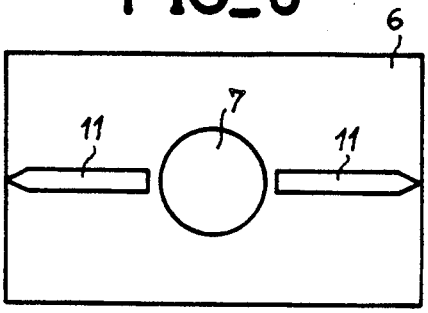

Excitation of the WG mode can also be carried out in accordance with FIGS. 5 and 6. In FIG. 5, a resonator 7 placed in a flat position on a substrate 6 is excited by two microstrip lines 9 which are oriented along a diameter of the resonator 7. The dielectric image waveguide equivalent of this device is shown in FIG. 6.

It has been stated earlier that a WG-mode resonator is capable of operating on a metallic substrate. It is readily apparent in this case that the microstrip line or lines 9 must be isolated from the substrate which may accordingly serve as a ground plane.

A whispering-mode resonator as defined in the foregoing within the scope of the invention accordingly consists of a flat disk in which the waves are trapped between a caustic surface and a lateral surface. This disk can be formed:

either by cutting-out a dielectric cylinder if the thickness 2*d* of the disk is sufficient, namely of the order of 0.2 mm or more, or by screen-process deposition of a dielectric paste on a metallic or resistive ceramic substrate if the thickness is sufficiently small to permit screen-process deposition (<0.5 mm). Deposition of a paste is particularly convenient since the permittivity of the paste can be varied by producing mixtures whereas the diameter and thickness of the resonator disk can be varied by means of the screens.

However, the invention further comprises a pseudo-planar resonator which operates in the WG mode and the structure of which can be readily integrated with hybrid or monolithic circuits.

In a planar resonator, the dielectric-air interface at the periphery of the disk approximately satisfies the conditions at the limits of an open circuit. In order to produce a pseudo-planar resonator, it is only necessary to simulate this open-circuit condition on a dielectric substrate.

A pseudo-planar resonator as shown in cross-section in FIG. 7 includes a dielectric substrate 6 which is metallized at 10 on a bottom face. The pseudo-planar resonator is defined at 12 by a metal ring 13 having a width w which is deposited on the top face of the substrate 6. The ring 13 and the metallization coating 10 simulate a magnetic short-circuit 14 within the body of the substrate 6 and this short-circuit constitutes an interface equivalent to the lateral wall of a cylinder. The flat disk of a whispering-mode resonator is therefore integrated in a substrate and is defined magnetically.

The WG modes excited within these resonators are of the same type as those presented earlier. Table V gives the resonance frequencies and the quality factors in respect of two pseudo-planar resonators.

The resonance frequencies are in good agreement with those of Table I in respect of two planar resonators.

It is also observed that the quality factors are higher when the width w of the metal ring 13 is greater owing to better compliance with the magnetic short-circuit condition.

The results obtained are due to the same type of excitation as for planar resonators and FIGS. 8 and 9 show two examples of these results. In FIG. 8, two microstrip lines 9 on the substrate 6 are coupled along a diameter with a metal ring 13 which defines the resonator 12. In FIG. 9, two dielectric image waveguides 11 placed on the substrate 6 are coupled along a diameter with a dielectric ring 15 and this latter is in turn placed on a metal ring which defines the resonator 12.

Planar or pseudo-planar resonators in the WG mode may be constructed in a number of different ways. One example consists in etching a flat disk in relief on a principal surface of a substrate, thus producing a result which is comparable with semiconductor mesas. Another example consists in etching a circular groove in a substrate, the disk being coplanar with the substrate.

It has been stated that the whispering-gallery phenomenon also develops in metals. Thus a resonator in the WG mode may be constructed by means of a disk or a metal ring but the substrate in this case is necessarily a dielectric.

Finally, since the whispering modes are confined between a caustic surface having a radius $a_c$ and a surface having a radius a and external to said caustic surface, the space within the caustic surface having a radius smaller than $a_c$ does not serve any purpose. Thus in certain forms of construction, a resonator may justifiably be designed in the form of a ring of material having a thickness 2*d*. This space can be employed for integrating other components such as semiconductor chips without impairing the properties of the whispering modes. A WG-mode resonator can therefore constitute the encapsulation package of a semiconductor device, said package being closed by a metal cap, and it has been noted earlier that this is not liable to impair the whispering modes since they do not radiate.

FIGS. 10 to 21 illustrate a number of examples of construction of planar and pseudo-planar WG-mode resonators. A sectional view associated with a plan view is given in the case of each figure. The reference numerals are constant for all figures and include in particular:

6: the substrate having a permittivity $\epsilon_r$

10: the ground plane

9: at least one coupling microstrip

11: at least one dielectric image waveguide.

The accompanying drawings illustrate the following examples of construction, depending on the case considered:

FIG. 10: a planar resonator as described in FIG. 3 and consisting of a flat dielectric disk 7 mounted on a substrate 6, FIG. 11: a planar resonator consisting of a flat disk 17 cut so as to form a mesa structure in a substrate 16 and having a permittivity which is different from that of the substrate 6, FIG. 12: a planar resonator consisting of a flat metallic disk 18 mounted on a dielectric substrate, FIG. 13: a planar resonator consisting of a metallic ring 19 mounted on a dielectric substrate, FIG. 14: a pseudo-planar resonator defined in a dielectric substrate by a very thin metallic ring 20 in order to simulate the external surface of the resonator and a very thin concentric metallic ring 21 for simulating the caustic surface, FIG. 15: a pseudo-planar resonator defined in a dielectric substrate by a very thin metallic ring 20 for simulating the external surface of the resonator, and a hole 22 formed in the substrate and equal in diameter to the caustic surface, FIG. 16: a pseudo-planar resonator consisting of a disk 23 cut in the form of a circular groove 24 in a dielectric substrate, FIG. 17: a pseudo-planar resonator defined in a dielectric substrate by a very thin metallic ring 20 and by a circular groove 25 formed in that face of the substrate which carries the ground plane, FIG. 18: a planar resonator 17 with a dielectric image waveguide 11 these two elements being cut so as to form a mesa structure in a dielectric substrate 16, FIG. 19: a planar resonator consisting of a dielectric disk 7 coupled with a dielectric image waveguide 11 mounted on a metallic substrate 26, FIG. 20: a resonator consisting of a metallic disk or ring 21 placed in a three-plate line and coupled with a microstrip 9, FIG. 21: a resonator consisting of a dielectric disk 7 placed in a metallic waveguide 100 and coupled with a microstrip 9 deposited on a dielectric substrate 6.

Further alternative embodiments are evident to those versed in the art by adopting combinations between the different substrates and the different forms of resonators and coupling means. Among others, all the resonators shown can be coupled to two microstrips 9 or two dielectric image waveguides 11.

These WG-mode resonators have highly advantageous properties in the field of millimeter-wave frequencies for the design of hybrid or monolithic circuits but also in the field of optical frequencies. They have characteristics which are close to those of the best designs in non-planar techniques such as metallic cavities.

Such resonators are employed in microwave electronics, in particular:

for frequency stabilization of oscillators, for the design of millimeter-wave power combiners, for passive or active microwave filtering.

TABLE I

| $\epsilon r = 9.6$ 2a = 19.0 mm | | | | | |
|---|---|---|---|---|---|
| 2d = 0.635 mm | | | 2d h = 1.3 mm | | |
| n | Freq. (GHz) | "Q" | n | Freq. (GHz) | "Q" |
| WGE 18,0,0 | 28.467 | 43 | WGE 18,0,0 | 28.885 | 59 |
| WGE 19,0,0 | 30.688 | 89 | WGE 19,0,0 | 30.940 | 72 |
| WGE 20,0,0 | 32.886 | 171 | WGE 20,0,0 | 32.752 | 273 |
| WGE 21,0,0 | 34.990 | 402 | WGE 21,0,0 | 34.563 | 172 |

n = number of periods in a disk, or order of mode.

TABLE II

| $\epsilon r = 9.6$ 2a = 13.8 mm 2d = 1.3 mm | | |
|---|---|---|
| n | Freq. (GHz) | "Q" |
| WGE 41,0,0 | 91.568 | 800 |
| WGE 42,0,0 | 94.117 | 904 |
| WGE 43,0,0 | 96.203 | 692 |
| WGE 44,0,0 | 98.678 | 795 |

TABLE III

| $\epsilon r = 9.6$ 2a = 13.8 mm 2d = 0.635 mm | | |
|---|---|---|
| n | Freq. (GHz) | "Q" |
| WGE 41,0,0 | 91.230 | 2850 |
| WGH 42,0,0 | 93.298 | 930 |
| WGE 42,0,0 | 93.805 | 2680 |
| WGH 43,0,0 | 96.010 | 1010 |
| WGE 43,0,0 | 96.370 | 2350 |
| WGH 44,0,0 | 98.684 | 1617 |
| WGE 44,0,0 | 98.911 | 2355 |

TABLE IV

| $\epsilon r = 36$ 2a = 14.8 mm 2d = 230 μm | | |
|---|---|---|
| n | Freq. (GHz) | "Q" |
| WGE 26,0,0 | 27.685 | 113 |
| WGE 27,0,0 | 29.683 | 117 |
| WGE 29,0,0 | 31.536 | 213 |
| WGE 31,0,0 | 33.287 | 250 |
| WGE 33,0,0 | 34.978 | 330 |
| WGE 34,0,0 | 36.586 | 580 |

TABLE V

| $\epsilon r = 9.6$ 2d = 0.635 mm | | | | | |
|---|---|---|---|---|---|
| Int. Diam. = 18.9 mm Ext. Diam. = 19.0 mm | | | Int. Diam. = 17.9 mm Ext. Diam. = 18.9 mm | | |
| n | Freq. (GHz) | "Q" | n | Freq. (GHz) | "Q" |
| WGE 17,0,0 | 27.844 | * | WGE 17,0,0 | 28.274 | 471 |
| WGE 18,0,0 | 29.680 | * | WGE 18,0,0 | 30.006 | 526 |
| WGE 19,0,0 | 31.520 | * | WGE 19,0,0 | 31.736 | 435 |
| WGE 20,0,0 | 33.334 | 331 | WGE 20,0,0 | 33.455 | 281 |
| WGE 21,0,0 | 35.131 | 326 | WGE 21,0,0 | 35.157 | 418 |
| WGE 22,0,0 | 36.908 | 188 | WGE 22,0,0 | 36.855 | 300 |
| WGE 23,0,0 | 38.669 | 216 | WGE 23,0,0 | 38.551 | 464 |

What is claimed is:

1. A microwave resonator having a resonant element for operation in the whispering-gallery mode, wherein the resonant element includes a flat circular disk having a diameter and a thickness, wherein said diameter is considerable larger than said thickness, and wherein said flat disk, when excited by an external excitation means, provides electromagnetic waves having resonant frequencies which are proportional to the diameter of the disk, said electromagnetic wave being confined in the whispering-gallery mode between a radius located at a periphery of the disk and a caustic internal surface having a radius smaller than the radius of said disk.

2. A resonator according to claim 1, wherein the resonant frequencies are independent of the thickness of the flat disk.

3. A resonator according to claim 1, wherein the resonant frequencies are determined by at least one of the mode (n) and the number of reflections of the electromagnetic wave at the periphery of the flat disk, said mode (n) being in turn determined by said excitation means external to the resonator which is electromagnetically coupled by one of a microstrip line and a dielectric image waveguide.

4. A resonator according to claim 1 wherein, when the electromagnetic wave is confined by the whispering-gallery mode, the electromagnetic wave does not radiate beyond the periphery of the resonator and wherein a substrate supports the resonator, said substrate being one of an isotropic, an anisotropic, a piezoelectric dielectric, a metallic and a resistive material.

5. A resonator according to claim 1 wherein, when the electromagnetic wave is confined between the periphery of the resonator and the caustic surface, the resonator is a ring having an external radius equal to that of the disk and an internal radius equal to that of the caustic surface.

6. A resonator according to claim 1, wherein the flat disk of the resonant element includes a dielectric substrate provided with a ground-plane metallization by at least one metallic ring which produces in combination with the ground plane a magnetic short-circuit having an internal radius equal to the external radius (a) of said resonator.

7. A resonator according to claim 1, wherein said resonator is constituted by a dielectric disk mounted separately on one of a dielectric and a metallic substrate.

8. A resonator according to claim 1, wherein said flat disk is a metallic ring mounted separately on a dielectric substrate.

9. A resonator according to claim 1, wherein said resonator is constituted by a disk cut so as to form a mesa structure in a dielectric substrate.

10. A resonator according to claim 1, wherein said resonator is constituted by two thin concentric metallizations deposited on a dielectric substrate.

11. A resonator according to claim 1, wherein said resonator is constituted by a thin metallization deposited on a dielectric substrate and by a hole cut in the substrate concentrically with said thin metallization deposit.

12. A resonator according to claim 1, wherein said flat disk is defined with respect to its diameter and thickness by a circular groove in a dielectric substrate.

13. A resonator according to claim 1, wherein said resonator is constituted by a metallic ring deposited on a first principal face of a dielectric substrate and by a groove cut in a second principal face of said substrate in vertically opposite relation to said metallic ring.

14. A resonator according to claim 1, wherein said flat disk includes a ring comprised of one of dielectric and metallic material embedded in a dielectric substrate having two faces, said substrate metallized on both faces and constituting a three-plate line, a microstrip line being also embedded in the substrate in the plane of the flat disk.

15. A resonator according to claim 1, wherein said disk is comprised of one of a dielectric and metallic material placed within a metallic waveguide, said flat disk aligned in parallel relation to one principal face of the waveguide, a microstrip line being also deposited on a dielectric substrate of an internal face of said waveguide.

16. A resonator according to claim 1, wherein said resonator is electromagnetically coupled with at least one metallic microstrip line deposited on a substrate in proximity to the disk of the resonant element.

17. A resonator according to claim 1, wherein said resonator is electromagnetically coupled with at least one dielectric image waveguide, said image waveguide is one of being inserted in a dielectric substrate and being deposited on a metallic substrate.

18. A resonator according to claim 1, wherein said disk is a screen process deposited disk on a substrate.

* * * * *